US008517178B2

(12) United States Patent
Logunov et al.

(10) Patent No.: US 8,517,178 B2
(45) Date of Patent: Aug. 27, 2013

(54) DEVICE AND METHOD FOR SEPARATING SOLID PARTICLES

(75) Inventors: Mekhti Logunov, Kharkov (UA); Alexander Katz, Donetsk (UA); Oleg Golobrodsky, Petach Tikva (IL); Gideon Drori, Sha'arei Tikva (IL)

(73) Assignee: Ecotech Recycling Ltd., Tel Aviv (IL)

( * ) Notice: Subject to any disclaimer, the term of this patent is extended or adjusted under 35 U.S.C. 154(b) by 201 days.

(21) Appl. No.: 13/059,840

(22) PCT Filed: Aug. 12, 2009

(86) PCT No.: PCT/IL2009/000795

§ 371 (c)(1),
(2), (4) Date: Apr. 29, 2011

(87) PCT Pub. No.: WO2010/020983

PCT Pub. Date: Feb. 25, 2010

(65) Prior Publication Data

US 2011/0203974 A1 Aug. 25, 2011

(30) Foreign Application Priority Data

Aug. 21, 2008 (IL) ..... 193633

(51) Int. Cl.
*B07B 7/00* (2006.01)

(52) U.S. Cl.
USPC ..... 209/146; 209/12.2; 209/135; 209/127.1; 241/19; 241/79.2

(58) Field of Classification Search
USPC ..... 209/135, 643, 644
See application file for complete search history.

(56) References Cited

U.S. PATENT DOCUMENTS

| | | | | |
|---|---|---|---|---|
| 1,383,441 | A * | 7/1921 | Sturtevant | 209/141 |
| 2,803,344 | A * | 8/1957 | Morrison | 209/127.4 |
| 2,885,077 | A * | 5/1959 | Herron | 209/133 |
| 4,172,028 | A * | 10/1979 | Dunn | 209/12.2 |
| 4,950,388 | A * | 8/1990 | Stafford | 209/135 |

(Continued)

FOREIGN PATENT DOCUMENTS

| | | |
|---|---|---|
| JP | 2003 001632 | 1/2003 |
| JP | 2004 136207 | 5/2004 |

(Continued)

OTHER PUBLICATIONS

International Search Report mailed Dec. 18, 2009 in International Application PCT/IL2009/000795, filed Dec. 8, 2009.

*Primary Examiner* — Terrell Matthews
(74) *Attorney, Agent, or Firm* — Novick, Kim & Lee, PLLC; Harold L. Novick; Jae Youn Kim

(57) ABSTRACT

A separation arrangement is provided for separating between particles of different materials having different densities and comprised in a mixture of fine particles. The arrangement comprises: a solid particles feed ingress means, a solid particles pushing/pulling means and at least one mesh adapted to stop particles of the lighter material. The particles comprised in the mixture are allowed to free fall within the separation arrangement, and particles of the lighter material are being extracted away from the free falling particles by the solid particles pushing/pulling means and conveyed towards the at least one mesh. The particles of the heavier material are allowed to complete their free fall and to reach the lower part of the separation arrangement.

7 Claims, 2 Drawing Sheets

(56) References Cited

U.S. PATENT DOCUMENTS

| | | | | |
|---|---|---|---|---|
| 5,032,256 | A | 7/1991 | Vickery | |
| 5,299,744 | A | 4/1994 | Garmater | |
| 5,570,789 | A * | 11/1996 | Dunn | 209/12.2 |
| 5,755,388 | A | 5/1998 | Yen et al. | |
| 5,887,803 | A | 3/1999 | Dietrich et al. | |
| 6,308,903 | B1 | 10/2001 | Mucciacciaro et al. | |
| 6,325,215 | B1 | 12/2001 | Anthony | |
| 6,359,246 | B1 * | 3/2002 | Essig et al. | 209/127.1 |
| 7,104,403 | B1 * | 9/2006 | Stephens et al. | 209/20 |
| 7,641,134 | B2 * | 1/2010 | Bohm et al. | 241/79.2 |
| 2002/0014440 | A1 | 2/2002 | Oder et al. | |
| 2005/0000863 | A1 | 1/2005 | Lean et al. | |
| 2011/0203974 | A1 * | 8/2011 | Logunov et al. | 209/135 |

FOREIGN PATENT DOCUMENTS

| | | |
|---|---|---|
| JP | 2008 104954 | 5/2008 |
| SU | 486 790 | 10/1975 |
| WO | WO 00/61292 | 10/2000 |
| WO | WO 2008/075470 | 6/2008 |

* cited by examiner

DEVICE AND METHOD FOR SEPARATING SOLID PARTICLES

FIELD OF INVENTION

The present invention relates to a method and apparatus for screening mixtures of fine particles. In particularly, this invention relates to a method and apparatus for separating between different materials comprised in a mixture of fine particles.

BACKGROUND OF THE INVENTION

There are quite a few industrial processes where one requires separating between different materials comprised in a mixture of particles having essentially a similar size.

Some of the solutions proposed in the past to deal with such a problem are:

U.S. Pat. No. 5,887,803 describes a process and an apparatus for grinding and sifting a product, in which the product is embrittled by a coolant and is comminuted in a mill and fed to a sifter. According to this publication, the product is comminuted and sifted in a closed-loop process without separating agents having to be fed to the ground product prior to sifting to overcome electrostatic charging.

U.S. Pat. No. 5,755,388 discloses a waste tire treating apparatus which comprises a grinding device for grinding the waste tire into blocks of smaller volume, a granulating device for cutting and granulating the dried waste tire into granules with predetermined volume, a heating device for heating and melting the waste tire granules and a sorting device disposed under the heating device for receiving the molten rubber, the nylon fibers and the steel filaments of the waste tire. The sorting device includes a channel with circulated water flow, whereby the mixture of the rubber and nylon fibers float on top of the water, while the steel filaments precipitate onto the bottom of the channel and are separately recovered.

U.S. Pat. No. 6,308,903 describes an apparatus and method for processing used vehicle tires that separates the steel metal from the rubber and other non-metallic materials for recycling. The tire is rotated at sufficient speed to force the materials outwardly by centrifugal force. Heated blades are used to melt and cut through the non-metallic materials, dividing the tire into at least two arcs that are held together by the steel reinforcement that is not easily cut through. Electric heating apparatus heats the steel to a higher temperature than the rubber so that the forces binding the rubber are released, thereby enabling the rubber and other non-metallic materials to be flung outwardly away from the steel and the steel is then collected separately.

U.S. Pat. No. 6,325,215 discloses a method for separating elastomeric particulates from a pulverized mixture wherein a first separator assembly separates out clean fiber and passes non-fibrous particulates and residual fiber to a second separator assembly that separates out clean non-fibrous particulates. The method includes propelling the pulverized mixture under a number of separator cylinders with mixture-engaging structure and against a structure for removing non-fibrous particulates and residual fibers from the pulverized mixture. The non-fibrous particulates and residual fibers are propelled under a plurality of other separator cylinders that include centrifugally releasable mixture-engaging structures and against a structure for separating non-fibrous particulates from the residual fibers.

Such separation processes, which are not too trivial, become rather complex processes when the mixtures are in the form of fine or even ultrafine particles, as most of the common methods are not applicable to handle particles of this size range.

SUMMARY OF THE INVENTION

It is an object of the present invention to provide a method and apparatus for efficiently separating mixtures which comprise fine particles of different materials.

It is another object of the present invention to provide a method and apparatus for carrying out a cost effective process that enables separating two or more different materials, being in the form of fine to ultrafine particles.

Other objects of the present invention will become apparent from the following description.

According to a first embodiment of the invention, there is provided a separation arrangement adapted for use in a process of separating between particles of different materials comprised in a mixture of fine particles, and wherein the arrangement comprises: a solid particles feed ingress means, a solid particles pushing/pulling means and at least one mesh adapted to stop particles of a first of the materials comprised in the mixture, and wherein particles comprised in the mixture of fine particles are allowed to free fall within the separation arrangement towards a lower part thereof, and wherein particles of the first of the materials comprised in the mixture (preferably of the lighter material) are being extracted away from the free falling particles by the solid particles pushing/pulling means and conveyed towards the at least one mesh, whereas particles of a second material of the mixture (preferably the heavier material) are allowed to reach the lower part of the separation arrangement.

The term "different materials" as used herein and throughout the specification and claims should be understood to encompass two or more materials having substantially different densities from each other, as well as at least one material having two distinct fractions of solid particles, wherein the particles in each of the fractions being substantially different from those of the other.

According to a preferred embodiment of the invention, the free falling particles are subjected to a gas blown thereat by the solid pushing/pulling means and/or subjected to vacuum applied there onto, so that particles of the lighter material (from among the materials comprised in the mixture) are extracted towards the at least one mesh.

In accordance with another preferred embodiment of the invention, the solid pushing/pulling means is a member of the group consisting of gas blower, fan, vacuum generating means, electrically charged means, magnets and the like. Preferably, the vacuum generating means are applied only when there is a substantial difference between the densities of the lighter particles and the heavy particles, as otherwise the resulting separation might be far from satisfactory.

According to another preferred embodiment of the present invention, the separation arrangement comprises an electrically charged mesh which is particularly of interest in case one of the materials comprised in the mixture is an electrically conducting material (e.g. metal). According to one option, the at least one mesh of the separation arrangement is the one that is charged electrically, whereas according to another option, there are at least two meshes in the separation arrangement where at least one mesh is electrically charged and the at least one other mesh is not charged electrically. The latter embodiment allows separation of a three materials mixture in which one of the materials is electrically conducting material, so that the particles of the light material are collected at the non-charged mesh, the particles of the electrically conducting material are collected at the electrically charged mesh, whereas the particles of the heavier material are collected at the lower part of the separation arrangement.

In the alternative, instead of or in addition to having an electrically charged mesh, electromagnets are used to remove the particles of the electrically conducting material comprised in the mixture (e.g. metal particles).

According to another preferred embodiment of the invention a typical dimension (e.g. average diameter) of the particles in the mixture is essentially in the range of from about 0.75 mm to about 1 micron.

In accordance with yet another preferred embodiment, the separation arrangement is adapted for use with a mixture of fine and/or ultra fine powder of particles derived from processing used tires, and the mixture of materials to be separated comprises rubber, metal and fiber particles.

According to still another embodiment the separation arrangement is adapted for use with a mixture of particles comprising plastic and metallic materials.

In accordance with another preferred embodiment, the solid particles feed ingress means is located essentially at the top section of the separation arrangement whereas an egress means for removing the heavier particles is located essentially at the bottom section of that separation arrangement.

By yet another preferred embodiment of the present invention, the gas blown by the gas blowing means is air and the blowing velocity is proportional to the density of the lighter falling particles.

According to still another embodiment of the invention, the separation arrangement further comprises sieving means adapted to sort particles of the heavier material reaching the bottom section of the arrangement in accordance with their physical size.

According to another aspect of the present invention there is provided a method for use in a separation process of fine powders. The method comprises the steps of:

providing a mixture of at least two different materials which comprises a plurality of solid particles, preferably having an average typical size of less than 0.75 mm;

feeding the plurality of solid particles into a separation chamber;

allowing the plurality of solid particles to free fall within the separation chamber;

extracting particles of one of the at least two different materials from among the falling solid particles;

collecting the extracted particles; and removing solid particles of the at least one other different material of the mixture out of the separation chamber.

In accordance with an embodiment of this aspect of the invention the extracted particles are of the lighter material from among the materials comprising the mixture, and preferably, the step of extracting the particles comprises blowing gas onto the falling solid particles where the gas is blown in a direction which is essentially perpendicular to the direction of the solid particles' fall.

DETAILED DESCRIPTION OF A PREFERRED EMBODIMENT

A better understanding of the present invention is obtained when the following non-limiting detailed examples are considered in conjunction with the accompanying drawings.

Figure 1:
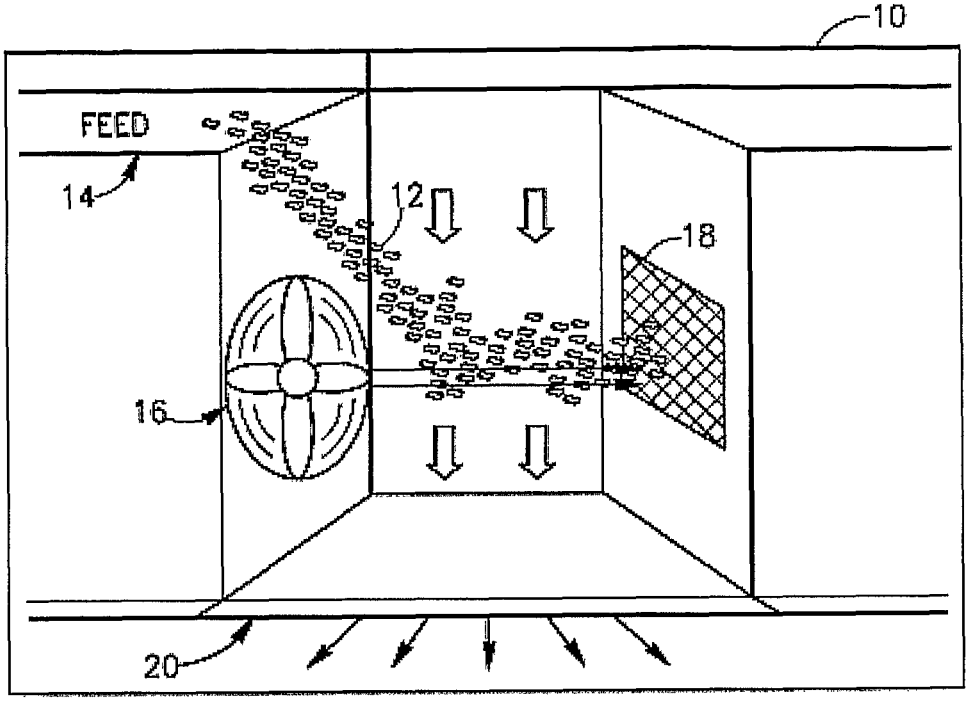
FIG. 1 illustrates a schematic diagram of the separation arrangement according to an embodiment of the present invention.

Let us consider first FIG. 1 where a mixture of two materials is introduced into separation chamber 10. The mixture is in the form of fine to ultrafine particles. As will be appreciated by those skilled in the art, FIG. 1 (as well as FIG. 2) are merely shown for illustration purposes only and in no way should be considered to depict the accurate particles' falling regime. Also, for the convenience of the reader the particles shown in these two figures are illustrated in a non-proportional scale, while in reality their typical size is less than 0.75 mm. As the material enters the chamber via ingress means 12, it is allowed to free fall over a substantially horizontal plane 14 located at the upper section of the chamber, towards the lower section of that chamber. Fan 16 is used to blow air onto the falling particles so that the lighter material is blown away from the falling mixture towards collecting mesh 18, thus being separated from the heavier particles based on physical differences existing between the two materials. In addition, vibrating sieves 20 are located at the bottom part of chamber 10 to sort the heavy particles according to their size distribution (e.g. to obtain fractions of the heavy particles at the required size range, and/or to separate in a three materials' mixture between particles of the two heavier materials, etc.).

Figure 2:
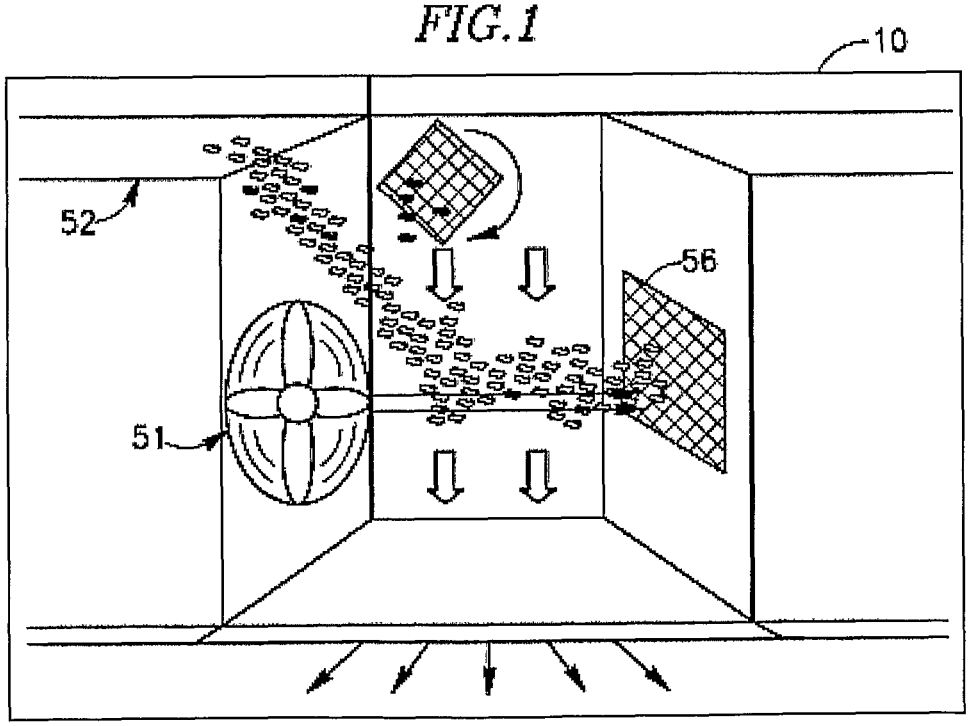
FIG. 2 illustrates a schematic diagram of the separation arrangement according to another embodiment of the present invention.

Let us now consider another example illustrated in FIG. 2 where a mixture of particles that comprises metal, rubber and textile (fluff) particles is fed into the upper section of the separation chamber 50 in a way similar to that described above in the embodiment illustrated in FIG. 1. This time, the mixture falls through an electromagnetic field generated by electromagnetic mesh 58 which causes the metal particles in the mixture to be attracted to and collected on an electromagnetic mesh 58 illustrated in this FIG. In the alternative, electromagnets may be used to collect the metal particles. The electromagnetic mesh cycles allowing the discharge of the metal particles therefrom so as to remove metal particles from among the falling particles and release the metal particles thus collected into a separation bin (not shown in this FIG.). As the remaining particles continue their free fall, fan 51 blows away the textile particles, being the lightest material, from among the remaining falling particles and the textile particles are then collected at mesh 56. The remaining heavier particles are then collected at the bottom section of the chamber.

Figure 3:
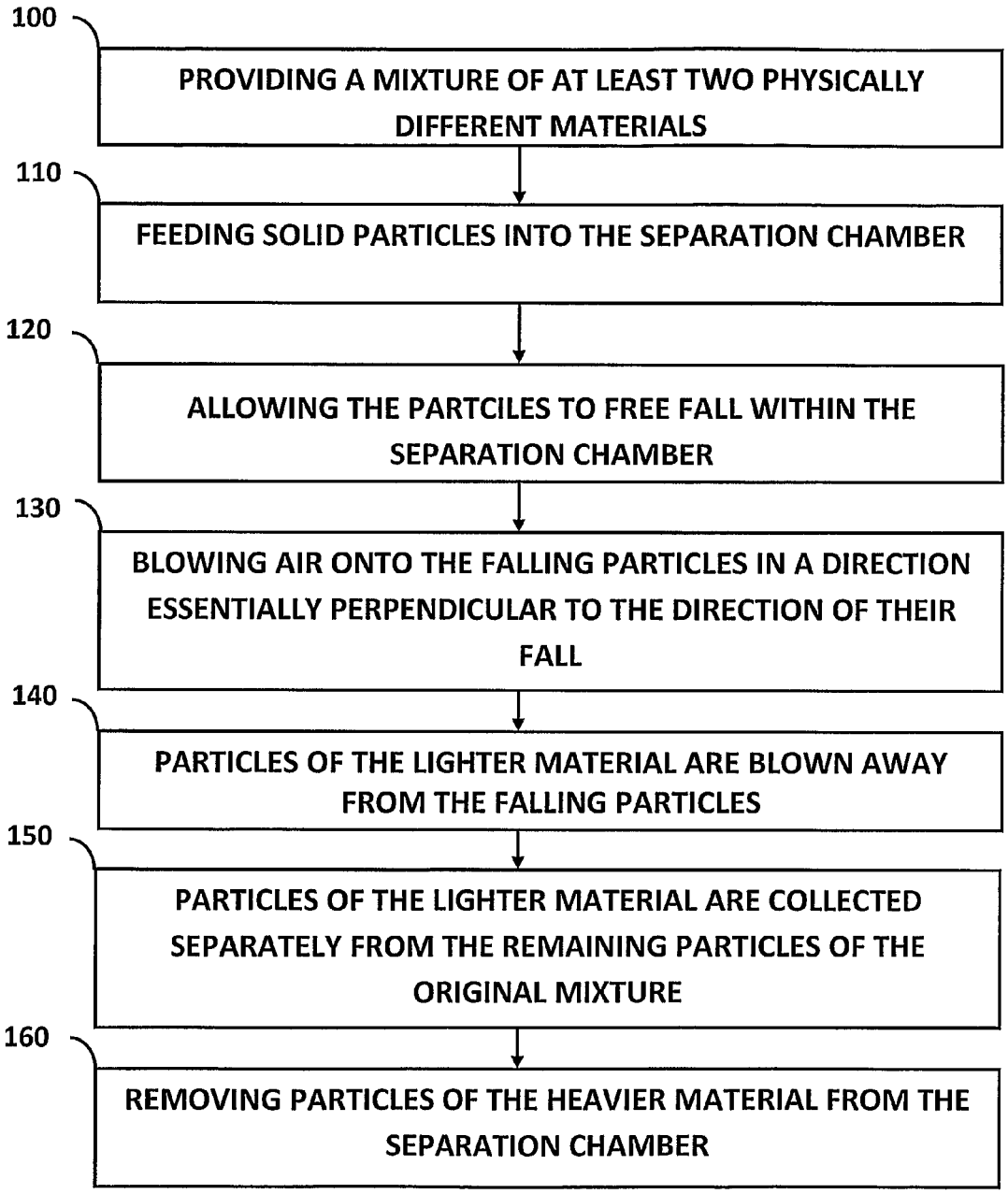
FIG. 3 exemplifies a method of carrying out the present invention.

FIG. 3 exemplifies a method according to an embodiment of the present invention. This example comprises the following steps: providing a mixture of at least two physically different materials (step 100), where the mixture comprises a plurality of solid particles preferably having a typical average size of less than 0.75 mm. The solid particles are then fed into a separation chamber (step 110) and are allowed to free fall within the separation chamber (step 120). Air is blown (step 130) onto the falling solid particles in a direction which is essentially perpendicular to the direction of the solid particles' fall. The particles of the lighter material are blown away from the falling solid particles (step 140) and are collected separately from these falling particles (step 150), thereby separating the particles comprised in the mixture. The solid particles of the heavier material are then removed out of the separation chamber (step 160).

The present invention has been described using non-limiting detailed descriptions of preferred embodiments that are provided by way of example and are not intended to limit the scope of the invention. It should be understood that features described with respect to one embodiment may be used with other embodiments. Variations of embodiments described will occur to persons of the art. Furthermore, the terms "comprise", "include", "have" and their conjugates shall mean, when used in the claims "including but not necessarily limited to". Also when term was used in the singular form it should be understood to encompass its plural form and vice versa, as the case may be.

The invention claimed is:

1. A separation arrangement adapted for use in a process of separating between particles of different materials and comprised in a mixture of fine particles, wherein the arrangement comprises: a solid particles feed ingress mechanism, a solid particles pushing/pulling mechanism selected from the group consisting of a gas blower, a fan, a vacuum generating mechanism and any combination thereof that results in the separating between said particles of different materials, and at least one mesh adapted to collect particles of one of the different materials, and wherein the particles comprised in the mixture are allowed to free fall within said separation arrangement towards a lower part thereof, and wherein the particles of said one of the different materials are being extracted away from said free falling particles by said solid particles pushing/pulling mechanism and conveyed towards said at least one mesh, thereby preventing the extracted particles from reaching the lower part of said separation arrangement, whereas the particles of a second material of the mixture are allowed to reach said lower part of said separation arrangement to be removed therefrom.

2. The separation arrangement according to claim 1, wherein said different materials include at least two materials and said at least two materials have substantially different densities from each other.

3. The separation arrangement of claim 1, wherein a typical dimension of solid particles in said mixture of fine particles is essentially in the range of from about 1 micron to about 0.75 mm.

4. The separation arrangement of claim 1, wherein said mixture of fine particles comprises particles of rubber, metal and fiber.

5. The separation arrangement of claim 1, wherein said mixture comprises plastic and metallic particles.

6. A method for use in a separation process of a mixture of fine powders, which comprises the steps of:

providing a mixture of at least two different materials comprising a first material and a second material, the mixture comprising a plurality of solid particles;

feeding the plurality of solid particles into a separation chamber;

allowing the plurality of solid particles to free fall within said separation chamber;

preventing the particles of the first material from reaching the lower part of said separation arrangement by extracting the particles of the first material from among the falling solid particles by using a solid particles pushing/pulling mechanism selected from the group consisting of a gas blower, a fan, a vacuum generating mechanism and any combination thereof, thereby separating between the at least two different materials comprised in the mixture of fine powders;

collecting the extracted particles of the first material; and removing solid particles of the second material, away from said separation chamber via the lower part of said separation arrangement.

7. The method according to claim 6, wherein the step of extracting the solid particles of said first material comprises blowing gas onto the falling solid particles in a direction which is essentially perpendicular to the direction of the solid particles' fall.

* * * * *